US006823828B2

(12) United States Patent
Nishi et al.

(10) Patent No.: US 6,823,828 B2
(45) Date of Patent: Nov. 30, 2004

(54) LUBRICATION UNIT FOR INTERNAL COMBUSTION ENGINE

(75) Inventors: Tohru Nishi, Saitama (JP); Yoshiaki Hori, Saitama (JP); Seiji Hamaoka, Saitama (JP); Masahiro Inoue, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/235,540

(22) Filed: Sep. 6, 2002

(65) Prior Publication Data

US 2003/0116115 A1 Jun. 26, 2003

(30) Foreign Application Priority Data

Sep. 19, 2001 (JP) ..... 2001-284898
Sep. 19, 2001 (JP) ..... 2001-284899

(51) Int. Cl.[7] ..... F01M 1/02
(52) U.S. Cl. ..... 123/196 R
(58) Field of Search ..... 123/196 R; 184/6.5

(56) References Cited

U.S. PATENT DOCUMENTS 5,887,564 A * 3/1999 Kawamoto ..... 123/196 R
6,314,934 B1 * 11/2001 Ito et al. ..... 123/196 R
6,382,171 B1 * 5/2002 Narita et al. ..... 123/196 R
6,443,263 B1 * 9/2002 Ito et al. ..... 123/196 R
6,527,087 B2 * 3/2003 Ito et al. ..... 184/6.5
6,591,819 B2 * 7/2003 Tscherne et al. ..... 123/196 R

FOREIGN PATENT DOCUMENTS

JP 2001-073736 3/2001

* cited by examiner

*Primary Examiner*—Henry C. Yuen
*Assistant Examiner*—Jason Benton
(74) *Attorney, Agent, or Firm*—Birch, Stewart, Kolasch & Birch, LLP

(57) ABSTRACT

A dry-sump lubrication unit for an internal combustion engine for a vehicle. A crankshaft of the vehicle is disposed so as to be parallel with the direction of travel of the vehicle, and in a position offset from a center of the vehicle when viewed from the front or back of the vehicle. A transmission shaft is disposed on the other side thereof. An oil tank is disposed in a crankcase located substantially at the lower center of the crankcase when viewed from the front or back of the vehicle on the rear side with respect to the traveling direction, and/or in a space between the crankcase and a rear case cover. Oil pumps are disposed forwardly of the oil tank. An oil injection pipe extends from the oil tank toward the side surface thereof on the transmission side. The resulting configuration prevents variations in liquid surface of lubricating oil of the vehicle internal combustion engine due to shaking of the vehicle body, and makes it possible to downsize the entire power unit.

14 Claims, 9 Drawing Sheets

LUBRICATION UNIT FOR INTERNAL COMBUSTION ENGINE

CROSS-REFERENCE TO RELATED APPLICATION

The present application claims priority under 35 U.S.C. §119 to Japanese Patent Application Nos. 2001-284898 and 2001-284899 filed on Sep. 19, 2001, the entire contents of which are hereby incorporated by reference.

BACKGROUND OF THE INVENTION

1. Field of the Invention

The present invention relates to a lubrication unit for a vehicle internal combustion engine, and more specifically to a dry-sump lubrication unit for a so-called vertical internal combustion engine having a crankshaft disposed in parallel with the traveling direction of the vehicle body.

2. Description of Background Art

One example of a dry-sump lubrication unit for a vertical internal combustion engine is disclosed in JP-A-2001-73736, in which a transmission chamber is disposed outside the crankshaft. A main shaft and a countershaft are disposed one above the other and constituting the transmission, with an output shaft disposed below the countershaft. An oil tank is disposed further outside the transmission chamber so that the lower end thereof extends to a position below the output shaft.

One problem associated with the lubrication unit of JP-A-2001-73736 is that the oil tank is disposed at the position significantly leaned on one side in the widthwise direction of the vehicle body, whereby the entire width of the engine increases and thus the loadability on the vehicle is deteriorated when the engine displacement is large and thus the transmission gear is upsized.

SUMMARY AND OBJECTS OF THE INVENTION

In order to solve the aforementioned problems in the related art, a first aspect of the present invention provides a dry-sump lubrication unit for an internal combustion engine disposed so that a crankshaft is disposed in parallel with the direction of travel of the vehicle body, comprising an oil tank disposed in a crankcase located at the substantially lower center when viewed from the front or back of the vehicle body on the rear side with respect to the traveling direction and/or in a space between the crankcase and the rear case cover.

Since the present invention is constructed in such a manner that, as described above, the oil tank is disposed at the substantially lower center when viewed from the front or back of the vehicle body, variations in liquid surface of oil due to shaking of the vehicle body can be minimized.

Furthermore, since the oil tank is disposed in the crankcase positioned on the rear side with respect to the traveling direction and/or in a space between the crankcase and the rear case cover, the space can be utilized effectively.

According to a second aspect of the present invention the oil pump is disposed forwardly of the oil tank. Therefore, the space can further be utilized effectively, and thus the entire power unit can be downsized.

According to a third aspect of the present invention, a crankshaft is disposed so as to lean widthwise on one side when viewed from the front or back of the vehicle body, a transmission shaft disposed on the other side thereof, an oil tank is disposed at the substantially widthwise center on the rear side of the vehicle body, and an oil injection pipe extends from the oil tank toward the side surface thereof on the transmission side.

Since the present invention is constructed in such a manner that, as described above, the crankshaft is disposed so as to be leaned widthwise on one side when viewed from the front or back of the vehicle body, the transmission is disposed on the other side thereof, and the oil tank is disposed at the substantially widthwise center on the rear side of the vehicle body, the space is effectively used, and thus the entire power unit can be downsized. In addition, since the oil tank is disposed at the substantially widthwise center of the vehicle body, variations in liquid level of oil due to shaking of the vehicle body is restrained, and a suction port of the oil pump is prevented from being affected by inclination, thereby stabilizing the lubrication pressure.

Since the oil injection pipe is provided so as to extend from the oil tank to the side surface thereof on the side of the transmission, replenishment or replacement of oil may be performed easily. In addition, since the position of the oil tank is not restricted in terms of workability, the space in the crankcase can be used effectively, and the crankcase may be downsized. Further, the oil tank can be placed at the center of the power unit as described above.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
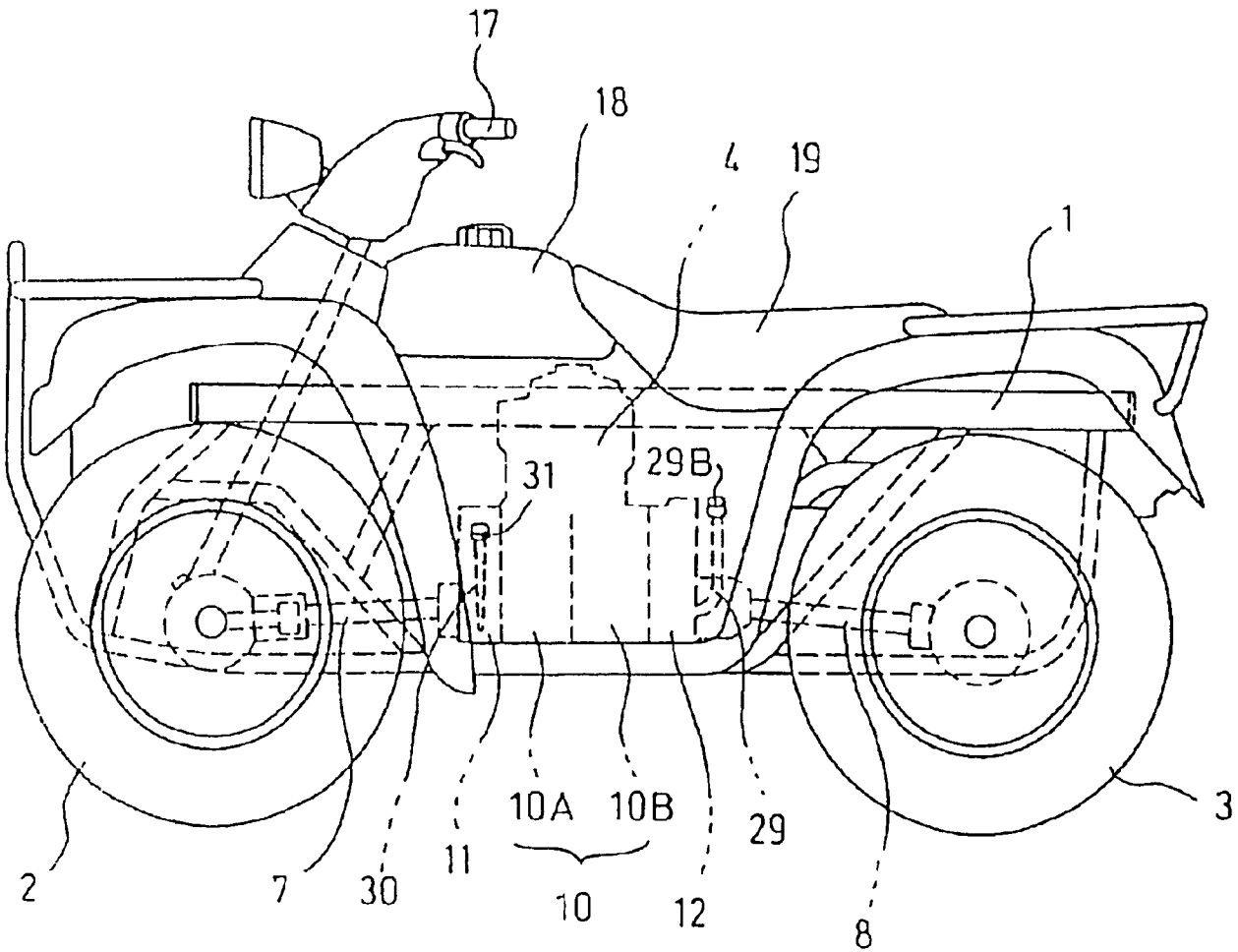
FIG. 1 is a general side view of the four-wheel buggy embodying the present invention.

Referring first to FIG. 1, the entire structure of the four-wheel buggy will be described in brief. The four-wheel buggy comprises pairs of left and right front wheels 2 and rear wheels 3 respectively at the front and rear of the vehicle body frame 1, and a power unit 4 having an internal combustion engine and a transmission integrated with each other supported by the vehicle body frame 1 at the center thereof. The power unit 4 is a vertical type in which the crankshaft 5 is disposed in the fore-and-aft direction of the vehicle body.

The four-wheel buggy is a four-wheel drive vehicle, in which the front wheels 2 and the rear wheels 3 are driven by the output shaft provided on the lower side of the power unit 4 in parallel with the crankshaft via the front wheel propeller shaft 7 and the rear wheel propeller shaft 8, respectively.

The crankcase 10 constituting the power unit 4 is covered by the front case cover 11 on the front side, and by the rear case cover 12 on the rear side, which constitute a power unit case. The crankcase 10 is further divided into the front portion and the rear portion, that is, the front case 10A and the rear case 10B. As will be described later, the rear case cover 12 is provided with an oil injection pipe 29 mounted thereon, and the front case cover 11 is provided with an oil gauge insertion hole 30 to which the oil gauge 31 is inserted. Other components shown in FIG. 1 include a handle 17, a fuel tank 18, and a saddle-riding type seat 19.

Figure 2:
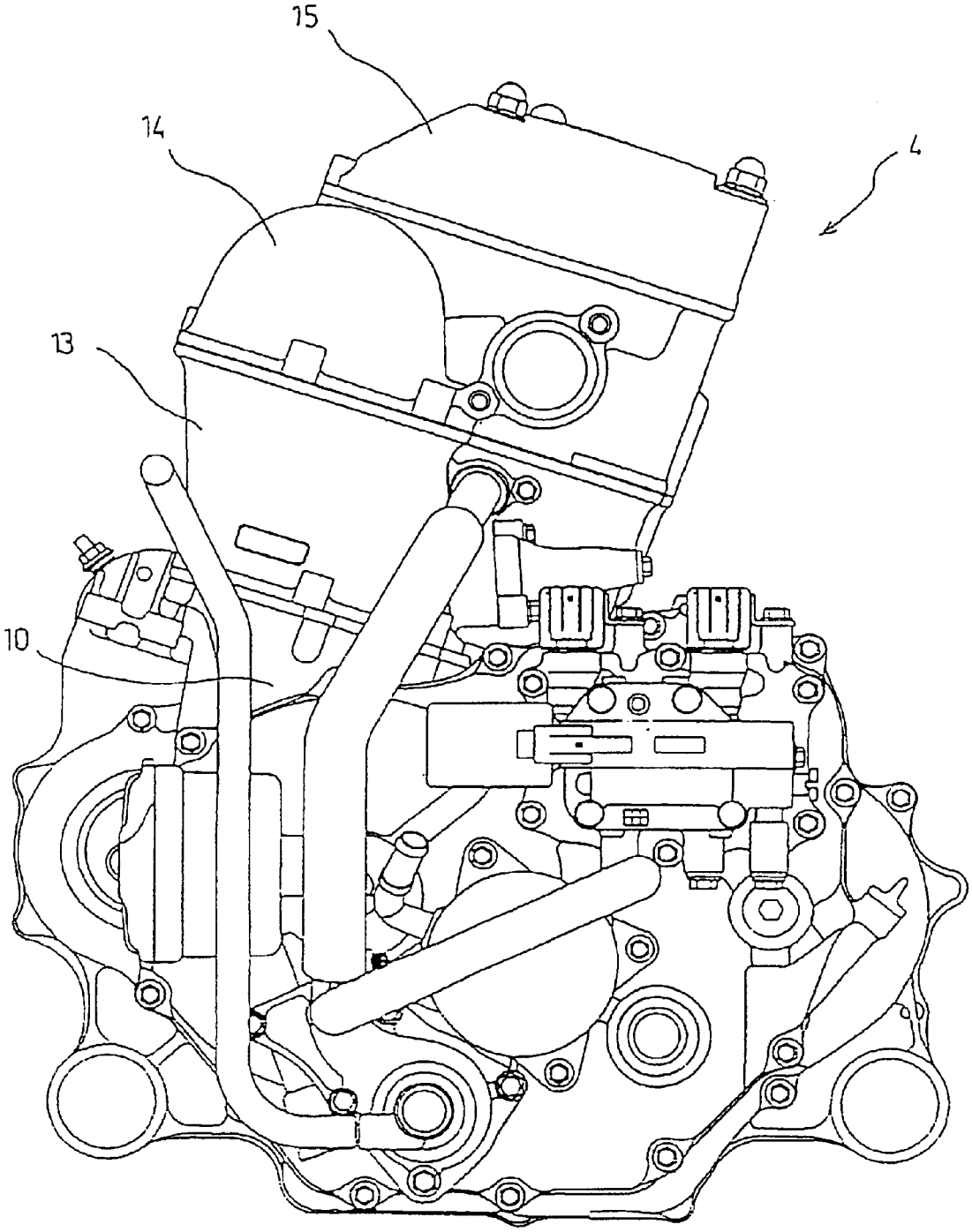
FIG. 2 is a front view of the power unit.

FIG. 2 is a front view of the power unit 4. The crankcase 10 is provided with a cylinder block 13, a cylinder head 14, and a cylinder head cover 15 on the upper side thereof.

Figure 3:
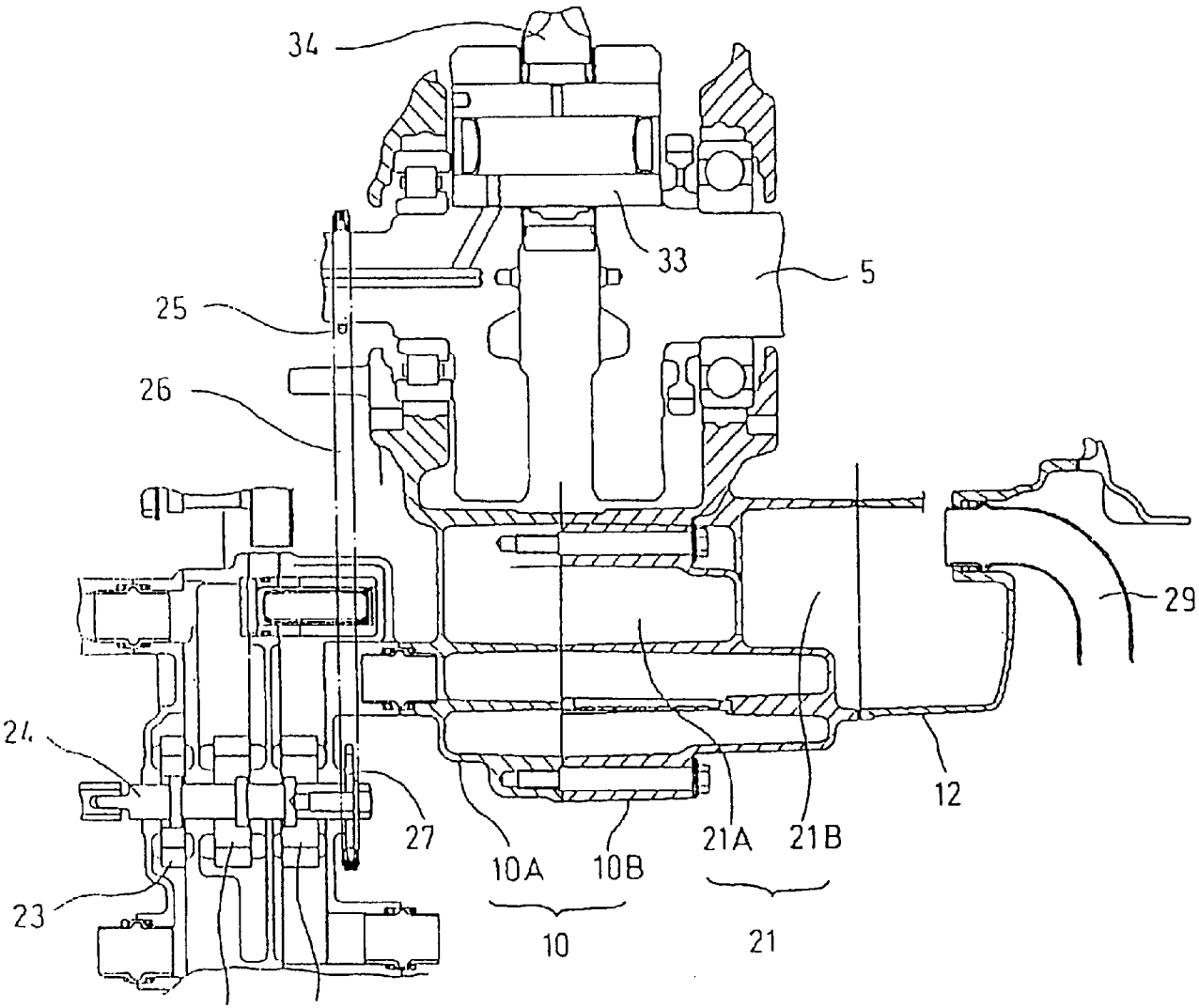
FIG. 3 is a vertical cross sectional view of the lower portion of the power unit.

FIG. 3 is a drawing showing schematically a vertical cross section of the lower portion of the power unit 4 taken along the plane in parallel with the axis of the crankshaft. The front side of the crankcase 10 including the front case 10A and the rear case 10B is covered by the front case cover, and the rear side thereof is covered by the rear case cover 12, which constitute a power unit case. In this embodiment, a front tank 21A and a rear tank 21B are formed between the front case 10A and the rear case 10B, and between the rear case 10B and the rear case cover 12 respectively. The front tank 12A and the rear tank 21B are in communication with each other and constitute an oil tank 21.

Scavenger pumps 22A, 22B, and the feed pump 23 are provided forwardly of the front tank 21A on the same oil pump shaft 24. These oil pumps are rotated by the crankshaft 5 via a drive sprocket 25, a chain 26, and a driven sprocket 27. The rear tank 21B is provided with an oil injection pipe 29 opening at the rear end thereof. Also shown in FIG. 3 are a crankpin 33, and a connecting rod 34.

Figure 4:
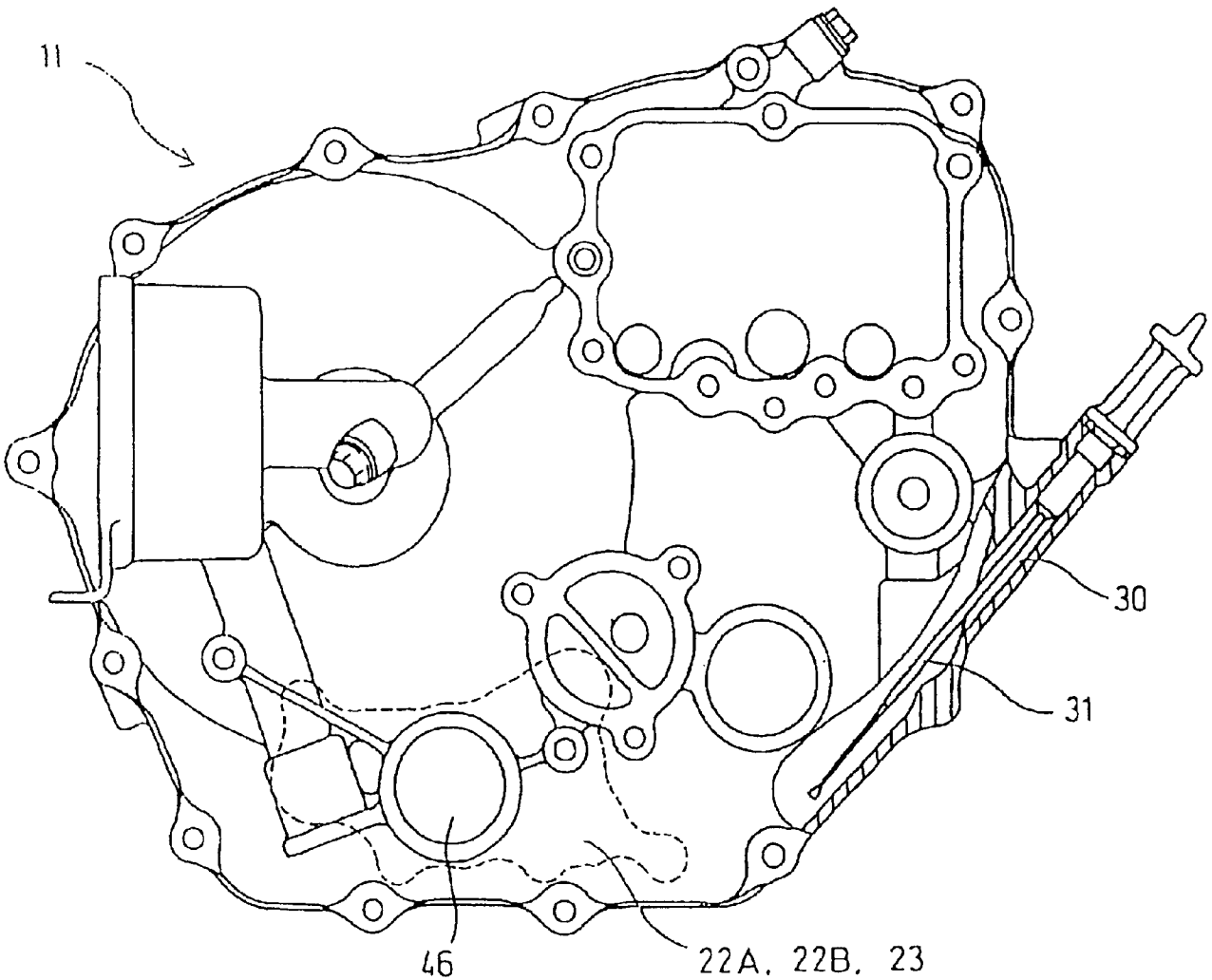
FIG. 4 is a front view of the front case cover.
Figure 5:
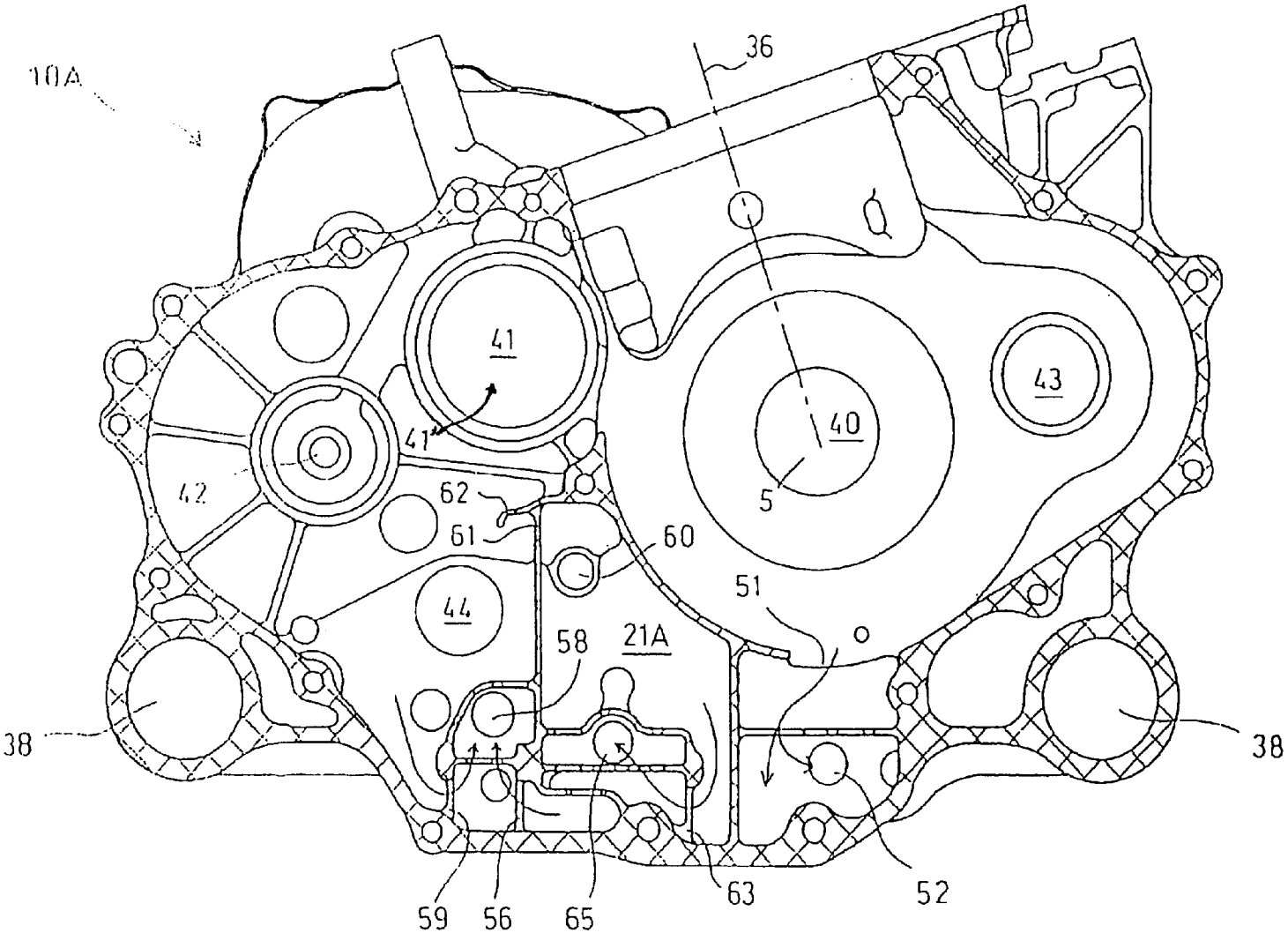
FIG. 5 is a back view of the front case.
Figure 6:
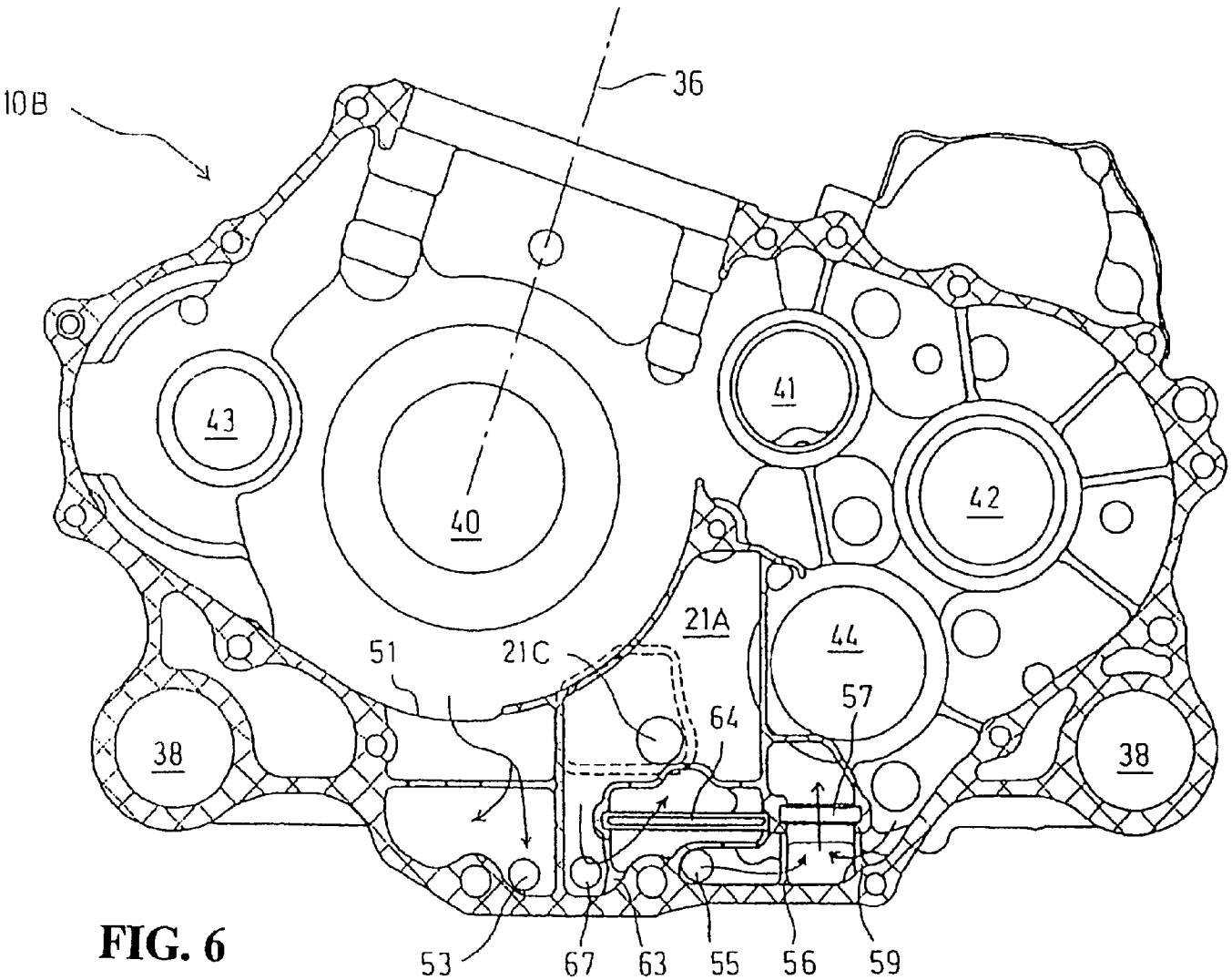
FIG. 6 is a front view of the rear case.
Figure 7:
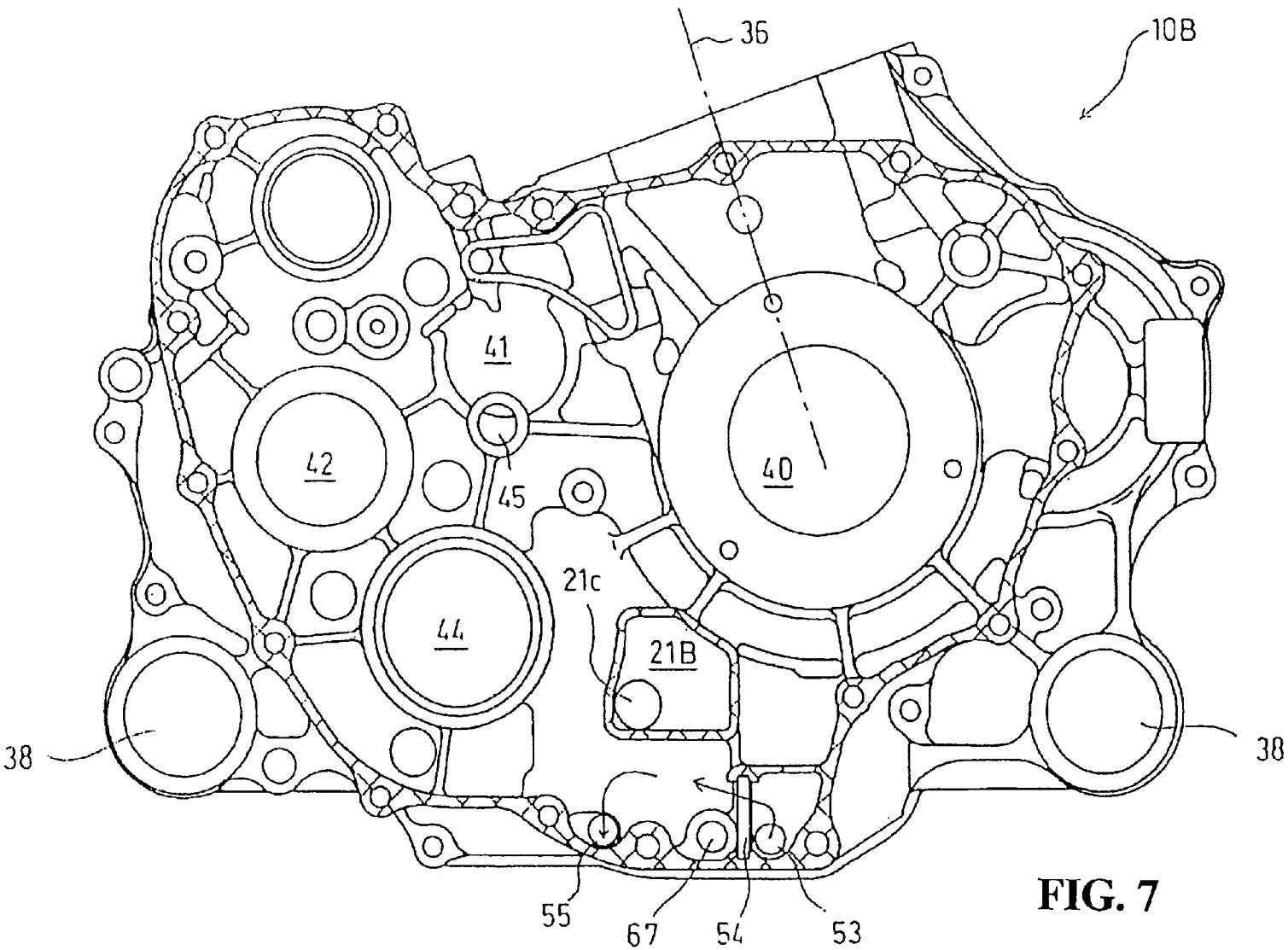
FIG. 7 is a back view of the rear case.
Figure 8:
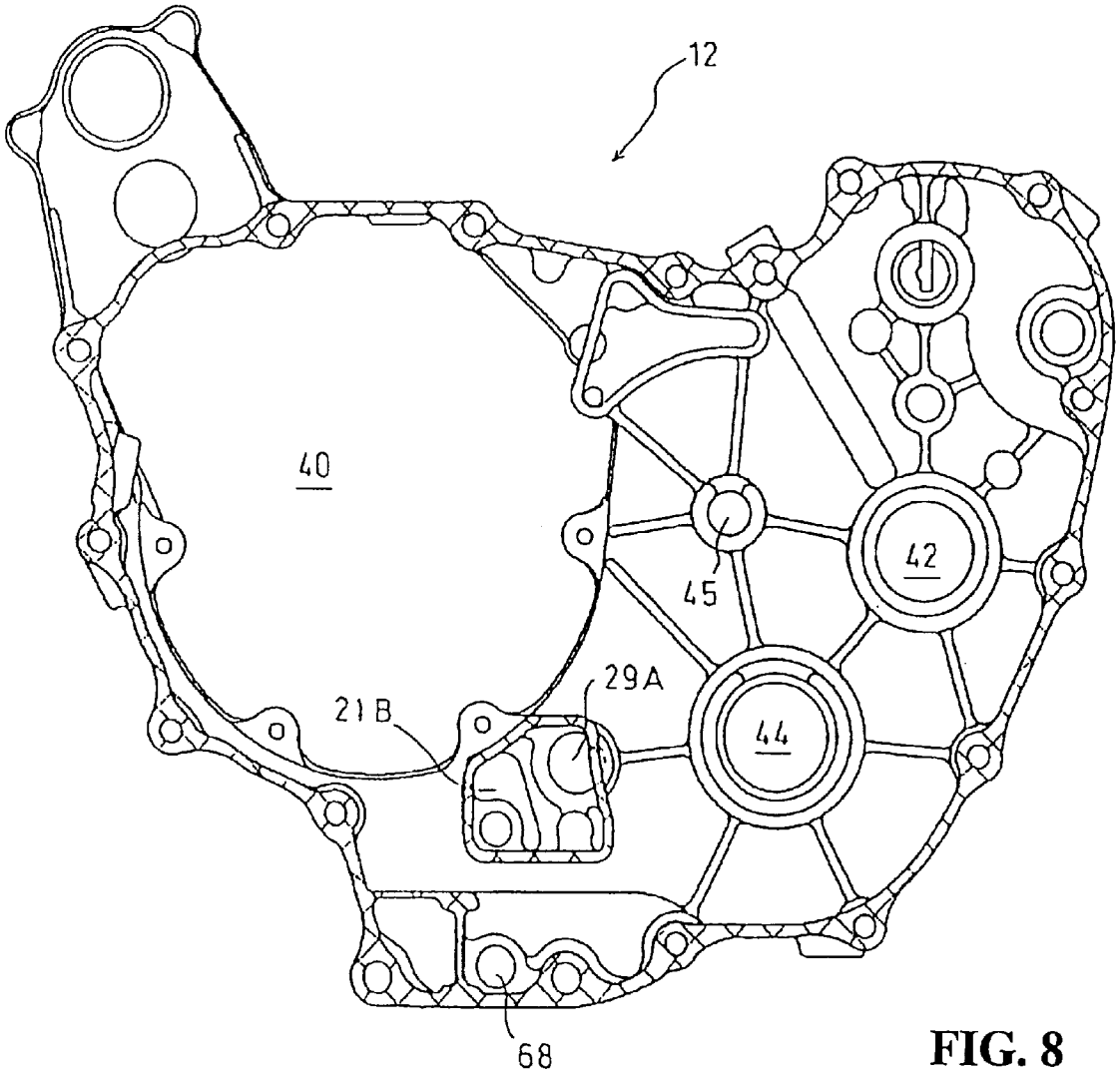
FIG. 8 is a front view of the rear case cove.
Figure 9:
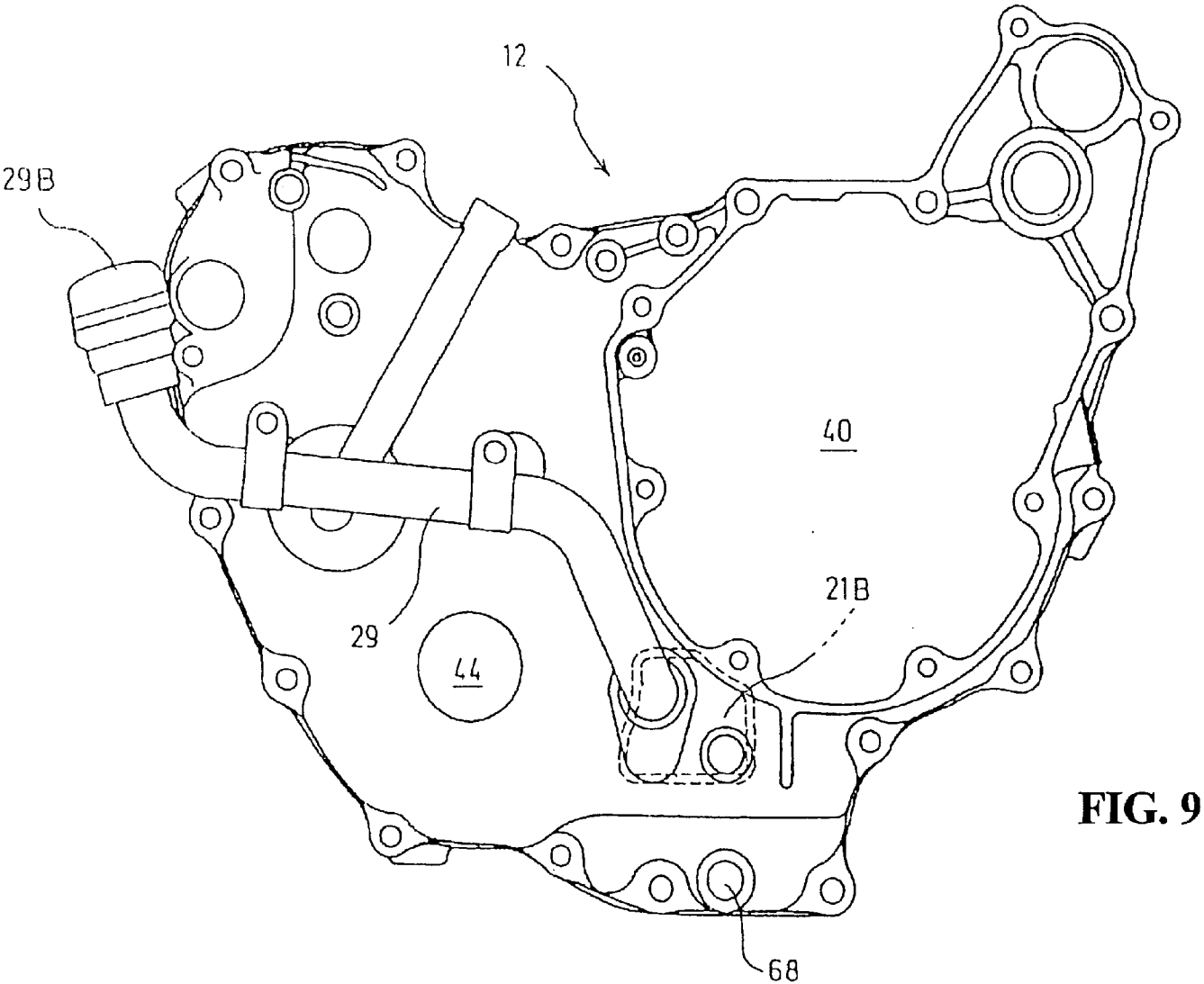
FIG. 9 is a back view of the rear case cover.

FIG. 4 is a front view of the front case cover 11, FIG. 5 is a back view of the front case 10A, FIG. 6 is a front view of the rear case 10B, FIG. 7 is a back view of the same rear case 10B, FIG. 8 is a front view of the rear case cover 12, and FIG. 9 is a back view of the same rear case cover 12. As is described above, the crankcase 10 including the front case 10A and the rear case 10B is attached with the front case cover 11 on the front side and the rear case cover 12 on the rear side, and these members constitute a power unit 4 case. The checkered portions in FIG. 5 through FIG. 8 represent mating surfaces of these members.

In FIG. 4 through FIG. 9, show a cylinder axis 36, a mounting hole 38 for mounting the crankcase 10 on the frame (FIGS. 5, 6, 7), a crankshaft hole 40 for a crankshaft 5, a main shaft hole 41 for a transmission shaft 41', a counter shaft hole 42, a balancer shaft hole 43, and an output shaft hole 44. The reference numeral 45 (FIGS. 7, 8) designates an intermediate shaft hole, the numeral 46 (FIG. 4) designates a pump shaft hole. As is described above, in this embodiment, the crankshaft 5 is disposed at the position leaned widthwise on one side of the vehicle body when viewed from the front or back of the vehicle body (in the example shown in the figure, the right side when viewed toward the traveling direction), and the main shaft hole 41 of the transmission on the other side, respectively.

As described above, the front tank 21A is formed between the front case 10A and the rear case 10B (FIGS. 5, 6), and the rear tank 21B is formed between the rear case 10B and the rear case cover 12 (FIGS. 7, 8), and these tanks are in communication with each other by the communication hole 21C to constitute an oil tank. The oil tank is, as is clear from FIG. 5 through FIG. 8, positioned at the substantially lower center of the vehicle body when viewed from the front or back of the vehicle body on the rear side of the vehicle body.

As shown in FIG. 9, the aforementioned rear case cover 12 is provided with the oil injection pipe 29 so as to extend toward the transmission side (in the example shown in the figure, the left side when viewed in the traveling direction). FIG. 8 shows an oil port 29A.

The front case cover 11 is, as shown in FIG. 4, formed with an oil gauge insertion hole 30 on the left side when viewed in the traveling direction, to which the oil gauge 31 is inserted. FIG. 4 also shows the positions of the oil pumps 22A, 22B, and 23. As shown in the figure, the oil pumps 22A, 22B, and 23 are also disposed forwardly of the oil tank at the lower positions.

The route of oil flowing in and out the oil tank will now be described.

In FIG. 5 and FIG. 6, oil that was used for lubricating bearings of the crankshaft or the like flows from the opening 51 on the lower portion of the crank chamber into the chamber positioned downwardly between the front case 10A and the rear case 10B and is trapped therein. Thereafter, a part of the oil is drawn into the first scavenger pump intake port 52 shown in FIG. 5 and fed to the oil cooler, not shown.

Another part of oil which has entered the lower portion of the crank chamber from the opening 51 flows through a communication hole 53 shown in FIG. 6 and FIG. 7 into the chamber between the rear case 10B and the rear case cover 12. The oil then passes through the filter 54 and then a communication hole 55 and back again into the crank case 10. Subsequently, it passes through the opening 56 and the filter 57 (FIG. 6), and then is drawn into the second scavenger pump intake port 58 shown in FIG. 5, and fed to the oil cooler.

On the other hand, oil that was used for lubricating the transmission chamber passes through the opening 59 shown in FIG. 5 and FIG. 6 and the filter 57 (FIG. 6), is drawn into the second scavenger pump intake port 58 shown in FIG. 5, and then is fed to the oil cooler.

Oil passed through the oil cooler, not shown, is discharged from the return port 60 extending from the oil cooler shown in FIG. 5 into the front tank 21A. Subsequently, it passes through the communication hole 21C and flows also into the rear tank 21B.

An overflow opening 61 allows oil to flow into the transmission chamber side when the oil tank 21 has overflowed, and a canopy top 62 prevents the overflowed oil from scattering toward the counter shaft. Overflowed oil passes through the opening 59 and the filter 57, and is drawn from the second scavenger pump intake port 58, and then is fed to the oil cooler in the same route as the oil used for lubricating the transmission chamber.

Oil in the front tank 21A flows from the opening 63 provided on the lower portion of the tank through the filter 64, and is drawn into the feed pump intake port 65, and then fed to the points on the internal combustion engine to be lubricated, the torque converter, the control unit, and the like.

FIG. 6 and FIG. 7 show drains hole 67, and FIG. 8 and FIG. 9 show drain hole 69.

In order to replenish or replace oil, the cap 29B of the oil injection pipe 29 is removed from the outside, and oil is injected through the oil injection pipe 29 into the rear tank 21B. By inserting the oil gauge 31 into the oil gauge insertion hole 30 provided on the same side (transmission side) of the power unit 4, the oil level can be checked therewith.

In this embodiment, since the oil tank 21 is disposed at the substantially lower center when viewed from the front or back of the vehicle body, variations in liquid surface of oil due to shaking of the vehicle body can be minimized, and a suction hole of the oil pump is prevented from being affected by inclination. Thus, the lubrication pressure can be stabilized.

In this embodiment, the crankshaft is disposed at the position leaned widthwise on one side of the vehicle body when viewed from the front or back of the vehicle body (in the example shown in the figure, the right side when viewed toward the traveling direction), the main shaft 41' of the transmission is disposed on the other side, the oil tank 21 is disposed at the substantially widthwise center on the rear side of the vehicle body as described above, and the oil pump is disposed forwardly thereof. Therefore, the entire power unit 4 can be downsized, and space can be utilized efficiently.

Furthermore, since the oil injection pipe 29 is mounted on the oil tank and extends toward the side surface thereof on the transmission side in this embodiment, replenishment or replacement of oil can be performed easily. Since the oil gauge insertion hole 30 is provided on the side surface of the transmission side and the oil gauge 31 is inserted therein, the oil level can be observed easily when replenishing or replacing oil.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A dry-sump lubrication unit for an internal combustion engine of a vehicle, comprising:

a crankshaft of the engine disposed in parallel with a direction of travel of the vehicle;

a crankcase located substantially at a lower center of the vehicle when viewed from a front or a back of the vehicle;

a rear case cover mounted of a rear side of said crankcase; and an oil tank provided in a rear side of said crankcase or in a space between the crankcase and said rear case cover, said crankshaft being disposed on either a right side or a left side of a center of the vehicle in a widthwise direction, and said oil tank being disposed at the center of the vehicle in the widthwise direction and in a position that is substantially lower than and to one side of said crankshaft.

2. The lubrication unit for an internal combustion engine according to claim 1, further comprising an oil pump disposed forwardly of the oil tank.

3. The lubrication unit for an internal combustion engine according to claim 1, wherein the oil tank includes a front tank formed between a front case and a rear case of said crankcase, and a rear tank formed between the rear case and said rear case cover, said front tank and said rear tank communicating with each other by a communication hole thereby constituting said oil tank.

4. The lubrication unit for an internal combustion engine according to claim 2, wherein the oil pump includes at least two scavenger pumps and a feed pump, said scavenger pumps and said feed pump being disposed together on an oil pump shaft.

5. The lubrication unit for an internal combustion engine according to claim 2, further comprising a front case cover mounted on a front side of the crankcase, wherein the oil pump is disposed facing a lower portion of the front case cover.

6. The lubrication unit for an internal combustion engine according to claim 5, wherein said front case cover is formed with an oil gauge insertion hole on one side thereof.

7. A dry-sump lubrication unit for an internal combustion engine for a vehicle disposed so that a crankshaft is disposed in parallel with the direction of travel of the vehicle, comprising:

an oil tank provided in a crankcase located at the substantially lower center when viewed from the front or back of the vehicle on a rear side with respect to the traveling direction and in a space between the crankcase and a rear case cover, said crankshaft being disposed on either a right side or a left side of a center of the vehicle in a widthwise direction, and said oil tank being disposed at the center of the vehicle in the widthwise direction and in a position that is substantially lower than and to one side of said crankshaft.

8. The lubrication unit for an internal combustion engine according to claim 7, further comprising an oil pump disposed forwardly of the oil tank.

9. The lubrication unit for an internal combustion engine according to claim 7, wherein the oil tank includes a front tank formed between a front case and a rear case of said crankcase, and a rear tank formed between the rear case and said rear case cover, said front tank and said rear tank communicating with each other by a communication hole thereby constituting said oil tank.

10. The lubrication unit for an internal combustion engine according to claim 7, wherein the oil pump includes at least two scavenger pumps and a feed pump, said scavenger pumps and said feed pump being disposed together on an oil pump shaft.

11. The lubrication unit for an internal combustion engine according to claim 8, further comprising a front case cover mounted on a front side of the crankcase, wherein the oil pump is disposed facing a lower portion of the front case cover.

12. The lubrication unit for an internal combustion engine according to claim 11, wherein said front case cover is formed with an oil gauge insertion hole on one side thereof.

13. A dry-sump lubrication unit for an internal combustion engine of a vehicle, comprising:

a crankshaft oriented in parallel with a direction of travel of the vehicle, said crankshaft being offset to either a right side or a left of the vehicle when viewed from a front or a back of the vehicle;

a transmission shaft disposed on the other of the right or left side of the vehicle;

an oil tank disposed substantially at a widthwise center on a rear side of the vehicle; and an oil injection pipe extending from the oil tank toward the side of the vehicle on which the transmission is disposed.

14. The dry-sump lubrication unit for an internal combustion engine of a vehicle according to claim 13, wherein the oil pump is disposed between and substantially lower than the crankshaft and the transmission shaft.

* * * * *